US012807292B2

(12) United States Patent
Ebuchi

(10) Patent No.: US 12,807,292 B2
(45) Date of Patent: Nov. 24, 2026

(54) OUTBOARD MOTOR AND BOAT

(71) Applicant: YAMAHA HATSUDOKI KABUSHIKI KAISHA, Iwata (JP)

(72) Inventor: Jun Ebuchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 194 days.

(21) Appl. No.: 18/934,523

(22) Filed: Nov. 1, 2024

(65) Prior Publication Data

US 2025/0153822 A1 May 15, 2025

(30) Foreign Application Priority Data

Nov. 9, 2023 (JP) ..... 2023-191229

(51) Int. Cl.
*B63H 20/28* (2006.01)
*B63H 21/17* (2006.01)

(52) U.S. Cl.
CPC ..... *B63H 20/28* (2013.01); *B63H 21/17* (2013.01)

(58) Field of Classification Search
CPC ..... B63H 20/28; B63H 20/285
See application file for complete search history.

(56) References Cited

U.S. PATENT DOCUMENTS 6,053,784 A * 4/2000 Takahashi ..... F01P 3/205 123/41.14
7,942,138 B1 * 5/2011 Belter ..... F01N 3/04 440/89 B
8,333,629 B2 * 12/2012 McChesney ..... F02B 61/045 440/88 P
9,932,100 B2 * 4/2018 Yamada ..... F01P 7/167
10,092,863 B1 * 10/2018 George ..... B63H 20/28
12,668,343 B2 * 6/2026 Takeda ..... B63H 20/28
2020/0102879 A1 * 4/2020 West ..... F01M 5/005
2022/0055728 A1 2/2022 Kimpara et al.
2022/0089261 A1 * 3/2022 Bruestle ..... B63H 23/321
2023/0086934 A1 3/2023 Kimpara et al.
2025/0153822 A1 * 5/2025 Ebuchi ..... B63H 20/001
2025/0153831 A1 * 5/2025 Ito ..... B60L 15/007
2025/0153832 A1 * 5/2025 Ito ..... B63H 21/17

FOREIGN PATENT DOCUMENTS

CN 201264717 Y 7/2009
JP 2022034677 A 3/2022
WO 2023084244 A1 5/2023

OTHER PUBLICATIONS

Official Communication issued in corresponding European Patent Application No. 24209485.2, mailed on May 6, 2025, 7 pages.

* cited by examiner

*Primary Examiner* — Magdalena Topolski
(74) *Attorney, Agent, or Firm* — Keating & Bennett, LLP

(57) ABSTRACT

An outboard motor includes a drive source, a motor controller, a coolant tube, a pump, and an air vent. The drive source includes an electric motor. The motor controller is higher than the electric motor and controls the electric motor. The coolant tube includes at least a portion of a coolant flow path through which the coolant that cools the electric motor and the motor controller circulates. The pump is connected to the coolant tube to pump the coolant. The air vent is located at an uppermost portion of the coolant flow path. The coolant pumped by the pump through the coolant flow path flows in an order of the motor controller, the air vent, and the electric motor.

17 Claims, 5 Drawing Sheets

OUTBOARD MOTOR AND BOAT

CROSS REFERENCE TO RELATED APPLICATIONS

This application claims the benefit of priority to Japanese Patent Application No. 2023-191229 filed on Nov. 9, 2023. The entire contents of this application are hereby incorporated herein by reference.

BACKGROUND OF THE INVENTION

1. Field of the Invention

The technologies disclosed in this document relate to outboard motors and boats.

2. Description of the Related Art

A boat includes a hull and an outboard motor mounted to a rear portion of the hull. The outboard motor is a device that generates thrust to propel the boat.

An outboard motor has been disclosed that includes an electric motor as a drive source, an inverter that controls the drive of the electric motor, a cooling water pipe that forms at least a portion of a cooling water flow path through which cooling water circulates to cool the electric motor and the inverter, and a pump connected to the cooling water pipe to circulate the cooling water (see, e.g., JP 2022-34677 A).

SUMMARY OF THE INVENTION

In an outboard motor that includes an electric motor as a drive source, it is desired to improve the cooling efficiency of each device of the outboard motor in order to improve the durability of the outboard motor.

Example embodiments of the present invention disclose technologies that solve one or more of the above-mentioned problems.

The technologies disclosed herein can be implemented in the following example embodiments.

An outboard motor includes a drive source, a motor controller, a coolant tube, a pump, and an air vent. The drive source includes an electric motor. The motor controller is located higher than the electric motor and is configured or programmed to control the electric motor. The coolant tube defines at least a portion of a coolant flow path through which coolant that cools the electric motor and the motor controller circulates. The pump is connected to the coolant tube to pump the coolant. The air vent is located at an uppermost portion of the coolant flow path. The coolant flow path is configured to cause the coolant pumped by the pump to flow in an order of the motor controller, the air vent, and the electric motor.

The technologies disclosed herein can be implemented in various example embodiments, including, e.g., outboard motors, boats provided with outboard motors and hulls, among other implementations, applications, or example embodiments.

In the outboard motor, e.g., when filling the coolant flow path with the coolant, if air also enters the coolant flow path, the air pumped by the pump along with the coolant will pass through the motor controller to reach the air vent located at the uppermost portion of the coolant flow path. This makes it less likely for air to be trapped near the motor controller, which is one of the devices of the outboard motor and tends to become relatively, hot thus improving the cooling efficiency of the outboard motor.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Figure 1:
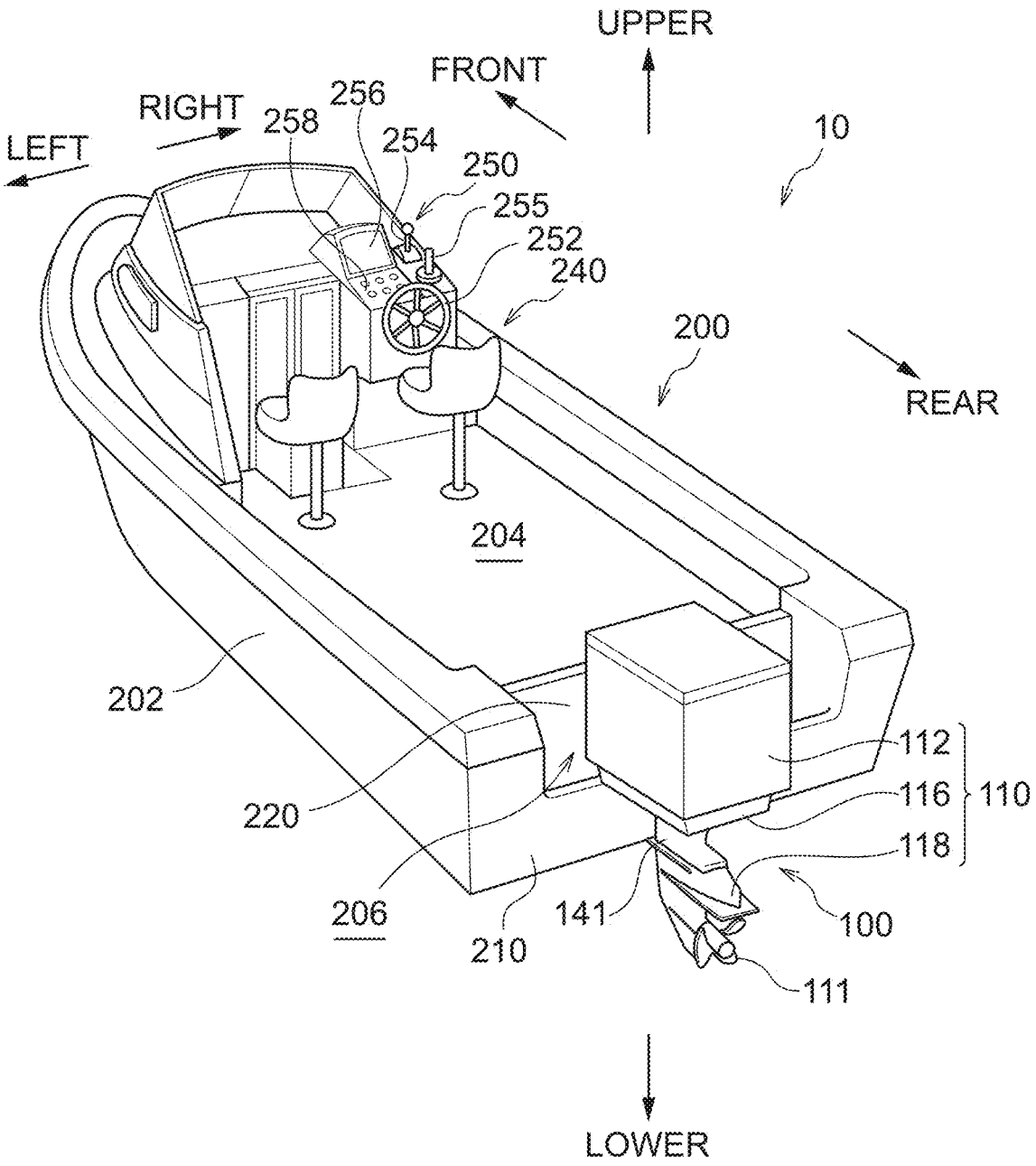
FIG. 1 is a perspective view schematically illustrating a configuration of a boat according to an example embodiment of the present invention.

FIG. 1 is a perspective view schematically illustrating a configuration of a boat 10 according to an example embodiment of the present invention. FIG. 1 and other drawings described below show arrows representing each direction with respect to the position of the boat 10. More specifically, each drawing shows arrows representing the front direction (FRONT), rear direction (REAR), left direction (LEFT), right direction (RIGHT), upper direction (UPPER), and lower direction (LOWER), respectively. The front-rear direction, left-right direction, and upper-lower direction are orthogonal to each other. It should be noted that, in this specification, axes, structures, and the like extending in the front-rear direction need not necessarily be parallel to the front-rear direction. Axes and structures extending in the front-rear direction include axes and structures inclined within the range of ±45° to the front-rear direction. Similarly, axes and structures extending in the upper-lower direction include axes and structures inclined within a range of ±45° to the upper-lower direction, and axes and structures extending in the left-right direction include axes and structures inclined within a range of ±45° to the left-right direction.

The boat 10 includes a hull 200 and an outboard motor 100. In an example embodiment, the boat 10 includes only one outboard motor 100, but the boat 10 may include a plurality of outboard motors 100.

The hull 200 is a portion of the boat 10 for occupants to ride. The hull 200 includes a hull main body 202 including a living space 204, a pilot seat 240 in the living space 204, and an operating device 250 near the pilot seat 240. The operating device 250 steers the boat and includes, e.g., a steering wheel 252, a shift/throttle lever 254, a joystick 255, a monitor 256, and an input device 258. The hull 200 includes a partition wall 220 to partition the rear end of the living space 204 and a transom 210 disposed at the rear end of the hull 200. In the front-rear direction, a space 206 is provided between the transom 210 and the partition wall 220.

Figure 2:
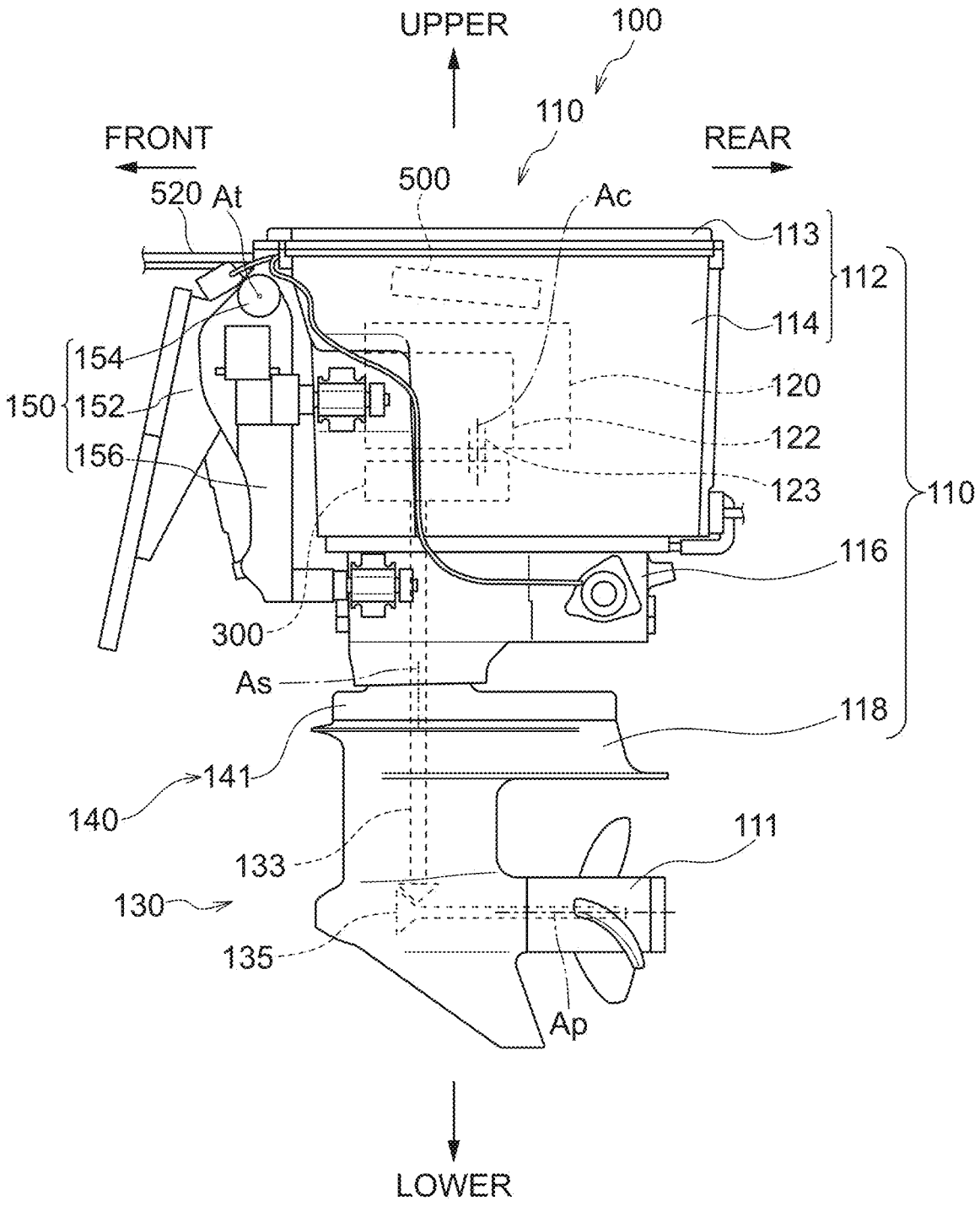
FIG. 2 is a side view schematically illustrating a configuration of an outboard motor according to an example embodiment of the present invention.

FIG. 2 is a side view schematically illustrating a configuration of an outboard motor 100. The outboard motor 100 in the reference attitude will be described below unless otherwise specified. The reference attitude is an attitude in which the rotation axis Ac of the output shaft 123, which will be described below, extends in the upper-lower direction, and the rotation axis Ap of the propeller shaft 135, which will be described below, extends in the front-rear direction. The front-rear direction, the left-right direction, and the upper-lower direction are respectively defined based on the outboard motor 100 in the reference attitude.

The outboard motor 100 generates thrust to propel the boat 10. The outboard motor 100 is attached to the transom 210 at a rear portion of the hull 200. The outboard motor 100 includes an outboard motor main body 110 and a suspension device 150.

The outboard motor main body 110 includes a waterproof case 112, a middle case 116, a lower case 118, a motor assembly 120, a control assembly 500, a transmission mechanism 130, a propeller 111, and a steering mechanism 140.

The waterproof case 112 is a housing located at an upper portion of the outboard motor main body 110. The waterproof case 112 houses an electric motor 122 described below and other electrical components to protect the electric motor 122 and other electrical components from being exposed to seawater. The waterproof case 112 includes an upper cover 113 defining an upper portion of the waterproof case 112 and a lower box 114 defining a lower portion of the waterproof case 112. The lower box 114 has a box-shaped configuration with an open top. The upper cover 113 is removably attached to the lower box 114 so as to cover the open top of the lower box 114.

The middle case 116 is a housing located below the waterproof case 112 and arranged near the center of the outboard motor main body 110 in the upper-lower direction. The upper portion of the middle case 116 is connected to the lower box 114 of the waterproof case 112.

The lower case 118 is a housing located below the middle case 116 and arranged at the bottom of the outboard motor main body 110.

The motor assembly 120 is housed inside the waterproof case 112. The motor assembly 120 includes an electric motor 122 as a driving source. The electric motor 122 is a prime mover that generates power. The electric motor 122 includes an output shaft 123 that outputs the driving force generated by the electric motor 122. The output shaft 123 is arranged in an attitude in which its rotation axis Ac extends in the upper-lower direction.

The control assembly 500 is housed inside the waterproof case 112 and is located higher than the motor assembly 120. The control assembly 500 controls the rotation of the electric motor 122 and the like. The detailed structure of the control assembly 500 is described below.

The transmission mechanism 130 transmits the driving force of the electric motor 122 to the propeller 111. The transmission mechanism 130 includes a primary reduction gear 300, a drive shaft 133, and a propeller shaft 135.

The primary reduction gear 300 is housed inside the waterproof case 112 and is located lower than the motor assembly 120. The primary reduction gear 300 is connected to the output shaft 123 of the electric motor 122 and the drive shaft 133. The primary reduction gear 300 reduces the driving force of the electric motor 122 and transmits it to the drive shaft 133. This allows the propeller 111 to rotate at a desired torque.

The drive shaft 133 is a rod-shaped member that transmits power to the propeller shaft 135 and is arranged in an attitude extending in the upper-lower direction. The drive shaft 133 is housed so that it spans the inside of the waterproof case 112, the inside of the middle case 116, and the inside of the lower case 118.

The propeller shaft 135 is a rod-shaped member that is arranged in an attitude extending in the front-rear direction at a height relatively lower than the outboard motor main body 110. The propeller shaft 135 rotates together with the propeller 111. The front end of the propeller shaft 135 is housed in the lower case 118, and the rear end of the propeller shaft 135 protrudes rearward from the lower case 118.

A gear is provided at the lower end of the drive shaft 133 and at the front end of the propeller shaft 135, respectively. The rotation of the drive shaft 133 is transmitted to the propeller shaft 135 by meshing the gears of the drive shaft 133 and the propeller shaft 135.

The propeller 111 is a rotating member with a plurality of blades and is attached to the rear end of the propeller shaft 135. The propeller 111 rotates along with the rotation of the propeller shaft 135 about the rotation axis Ap. The propeller 111 generates thrust to propel the boat 10 by rotating.

The steering mechanism 140 controls changes in the traveling direction of the boat 10. The steering mechanism 140 includes a steering shaft 141. The steering shaft 141 is a hollow tubular member arranged to surround the outer circumference of the drive shaft 133. At least a portion of the steering shaft 141 is housed in the middle case 116 and is supported so as to be rotatable about the rotation axis As. The lower portion of the steering shaft 141 protrudes downward from the middle case 116 and is connected to the lower case 118. The steering shaft 141 rotates about the rotation axis As, for example, by the driving force of the drive motor (not shown) housed in the middle case 116. When the steering shaft 141 rotates, the lower case 118 connected to the steering shaft 141 also rotates, and the direction of the propeller 111 is changed. This changes the direction of the thrust generated by the propeller 111 to enable the steering of the boat 10.

The suspension device 150 attaches the outboard motor main body 110 to the hull 200. The suspension device 150 includes a pair of left and right clamp brackets 152, a tilt shaft 154, and a swivel bracket 156.

The pair of left and right clamp brackets 152 are disposed behind the hull 200 in a state separated from each other in the left-right direction and are fixed to the transom 210 of the hull 200 by using, e.g., bolts.

The tilt shaft 154 is a rod-shaped member and is rotatably supported by the clamp brackets 152. The tilt axis At, which is the center line of the tilt shaft 154, defines the horizontal (left-right) axis of the outboard motor 100 during tilting.

The swivel bracket 156 is sandwiched between the pair of clamp brackets 152 and is supported by the clamp brackets 152 via the tilt shaft 154 so as to be rotatable about the tilt axis At. The swivel bracket 156 is driven to rotate about the tilt axis At relative to the clamp bracket 152 by a tilting device (not shown) that includes an actuator such as a hydraulic cylinder.

When the swivel bracket 156 rotates about the tilt axis At with respect to the clamp bracket 152, the outboard motor main body 110 supported by the swivel bracket 156 also rotates about the tilt axis At. This achieves the tilting operation of rotating the outboard motor main body 110 in the upper-lower direction with respect to the hull 200. By this tilting operation, the outboard motor 100 can change the angle of the outboard motor main body 110 about the tilt axis At in the range from the tilt-down state in which the propeller 111 is disposed under the water (the state in which the outboard motor 100 is in the reference attitude) to the tilt-up state in which the propeller 111 is disposed above the water surface. Trimming operation to adjust the attitude of the boat 10 during travel can also be performed by adjusting the angle about the tilt axis At of the outboard motor main body 110.

Figure 3:
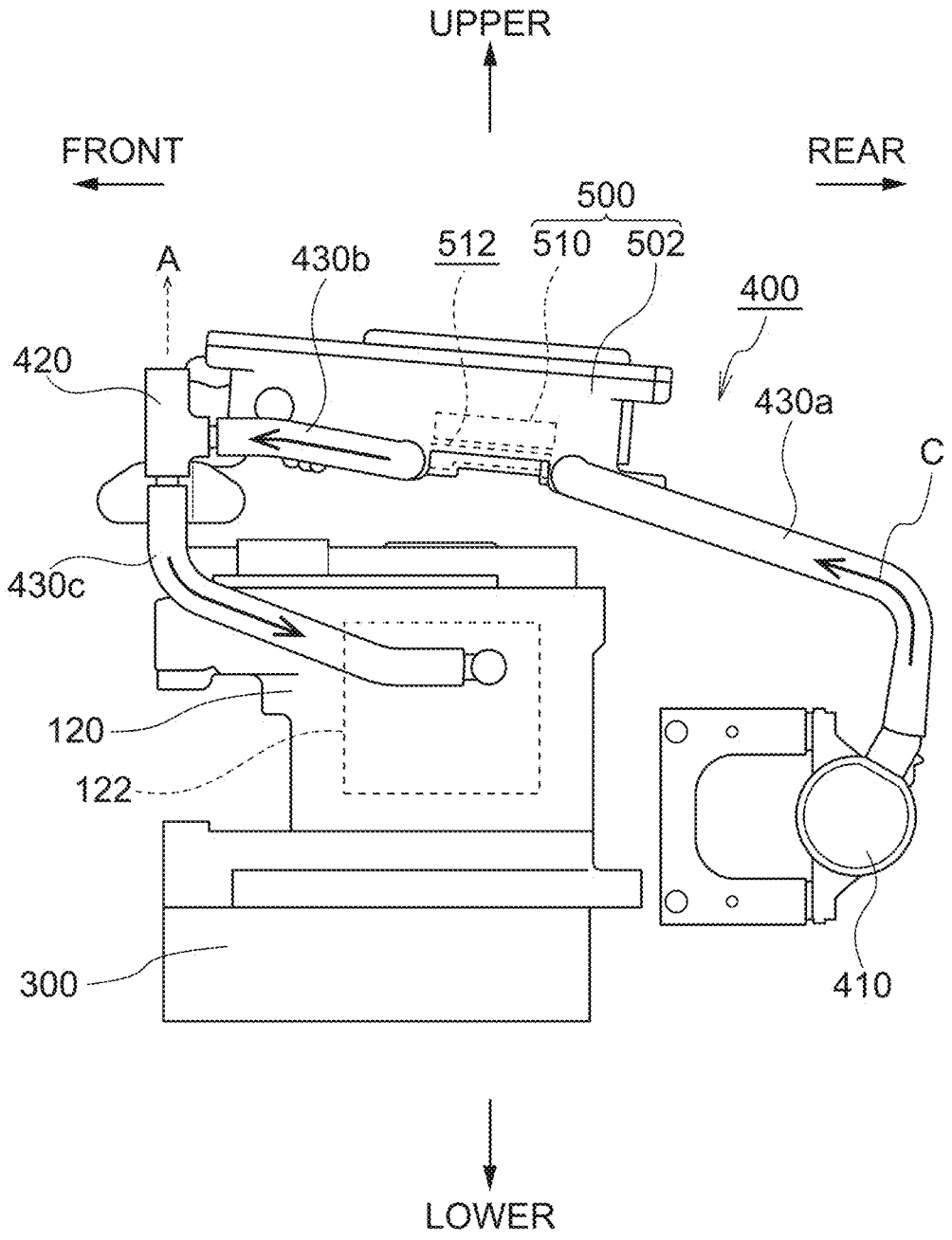
FIG. 3 is an explanatory view schematically illustrating a portion of the internal configuration of an outboard motor main body.
Figure 4:
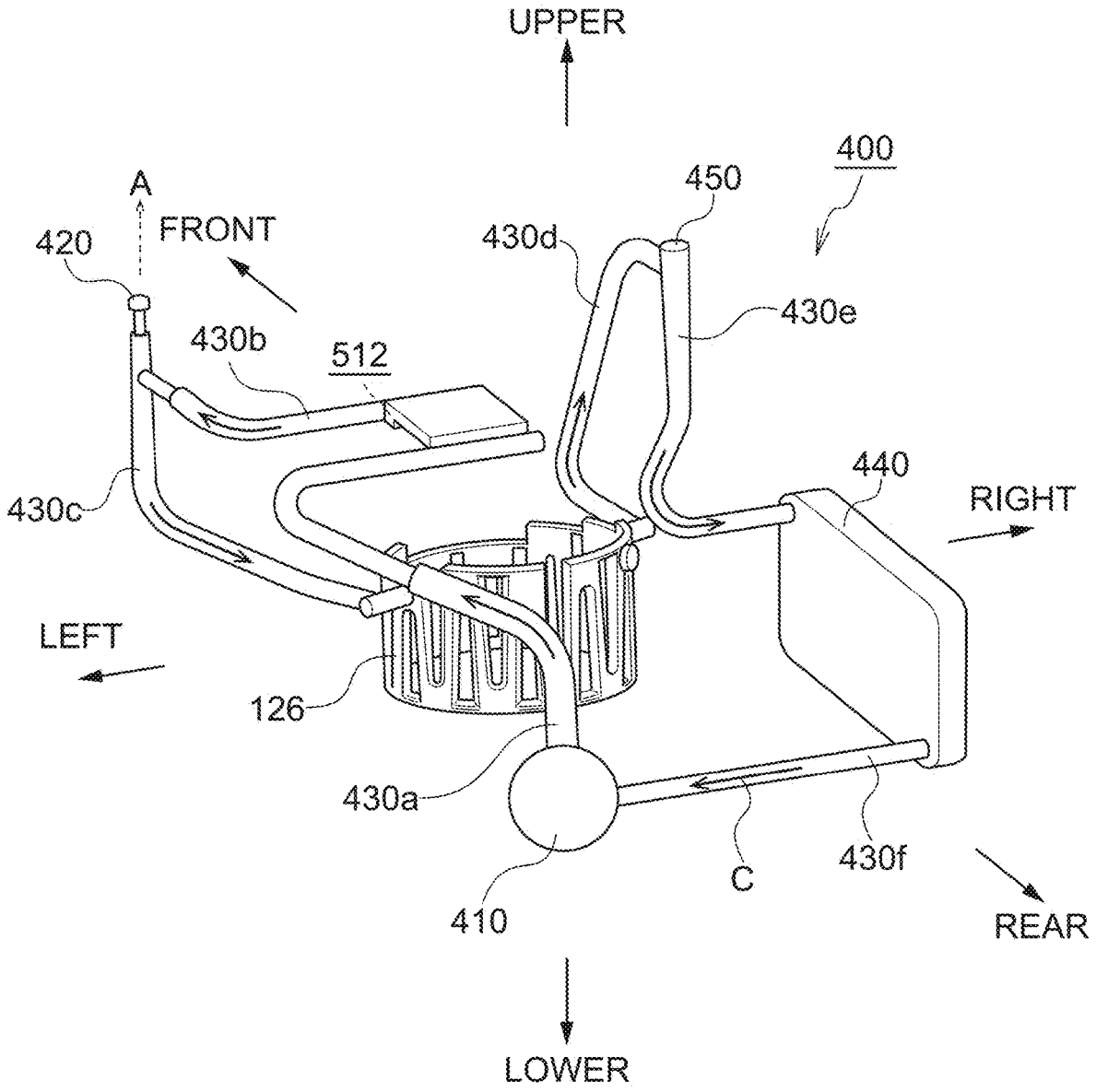
FIG. 4 is an explanatory view illustrating a configuration of a coolant flow path.

FIG. 3 is an explanatory view schematically illustrating a portion of the internal configuration of the outboard motor main body 110. FIG. 4 is an explanatory view illustrating a configuration of a coolant flow path 400. FIGS. 3 and 4 show the internal structure housed within the waterproof case 112. As shown in FIGS. 3 and 4, the outboard motor 100 includes the coolant flow path 400, which is a series of flow paths through which coolant liquid C circulates.

The coolant liquid C circulates inside the outboard motor main body 110 to cool the electric motor 122 and the MCU 510 described below. The coolant liquid C is an antifreeze solution mainly including, e.g., ethylene glycol or propylene glycol. The coolant liquid C is an example of the coolant.

As shown in FIG. 3, the control assembly 500 includes a controller case 502, a motor control unit (MCU) 510, and a power supply line 520 (see FIG. 2). The MCU 510 is a circuit board that controls the rotation of the electric motor 122 and the like. The controller case 502 houses the MCU 510. Inside the controller case 502, there is a space 512 that is a flow path for the coolant liquid C. In other words, the coolant flow path 400 includes the space 512 inside the controller case 502. The power supply line 520 supplies power to the MCU 510 from a battery or the like (not shown) installed in the hull 200. The MCU 510 is an example of the motor controller.

As shown in FIG. 4, the outboard motor 100 further includes a motor cooler 126, an air vent 420, a filler 450, a heat exchanger 440, a pump 410, and a plurality of coolant tubes 430*a* to 430*f*.

The motor cooler 126 has a ring-shaped configuration when viewed in the upper-lower direction and surrounds the outer circumference of the electric motor 122. Inside the motor cooler 126, a space is provided that is a flow path for the coolant liquid C. In other words, the coolant flow path 400 includes the space inside the motor cooler 126.

The air vent 420 includes an opening to release air that has mixed into the coolant flow path 400 to the atmosphere. By removing air from the coolant flow path 400, the air vent 420 improves the cooling efficiency of the electric motor 122 and the MCU 510. The air vent 420 is located at an uppermost portion of the coolant flow path 400.

The filler 450 includes an opening that functions as a filling port for the coolant liquid C in the coolant flow path 400. The opening of the filler 450 also has a function to release air that has mixed into the coolant flow path 400 to the atmosphere. The filler 450 is located at a relatively higher position in the coolant flow path 400, and more specifically, it is located at a position higher than the electric motor 122 and the motor cooler 126.

The heat exchanger 440 is a device in which heat exchange occurs between the coolant liquid C and seawater that is pumped up from outside the outboard motor 100 by a pump (not shown). The coolant liquid C becomes relatively hot as it passes near the electric motor 122 and the MCU 510 and is cooled by exchanging heat with seawater in the heat exchanger 440.

The pump 410 pumps the coolant liquid C. The pump 410 is connected to the coolant tube 430*a* described below and the coolant tube 430*f* described below. The coolant liquid C circulates through the coolant flow path 400 by the operation of the pump 410. The pump 410 is located at a relatively lower position in the coolant flow path 400, and more specifically, it is located at a height lower than the MCU 510 and the controller case 502.

The plurality of coolant tubes 430*a* to 430*f* are tubular structures that are hollow from one end to the other end, and the space inside each structure defines at least a portion of the coolant flow path 400. Each of the coolant tubes 430*a* to 430*f* is configured such that the coolant liquid C flows from one end to the other end by the operation of the pump 410.

The coolant tube 430*a* defines a portion of the coolant flow path 400 that extends from the pump 410 to the controller case 502. One end of the coolant tube 430*a* is connected to the pump 410 to communicate with the flow path of the coolant liquid C in the pump 410. The other end of the coolant tube 430*a* is connected to the controller case 502 to communicate with the space 512 in the controller case 502.

The coolant tube 430*b* defines a portion of the coolant flow path 400 that extends from the controller case 502 to the air vent 420. One end of the coolant tube 430*b* is connected to the controller case 502 to communicate with the space 512 in the controller case 502. In addition, the other end of the coolant tube 430*b* is connected to one end of the coolant tube 430*c* to communicate with the coolant tube 430*c*. In addition, the lower end of the coolant tube 430*b* (the lowest portion in the coolant tube 430*b*) is connected to the controller case 502. The coolant tube 430*b* is an example of the first coolant tube.

The coolant tube 430*c* defines a portion of the coolant flow path 400 that extends from the air vent 420 to the motor cooler 126. One end of the coolant tube 430*c* is connected to the air vent 420. The other end of the coolant tube 430*c* is connected to the motor cooler 126 to communicate with the space inside the motor cooler 126.

The coolant tube 430*d* defines a portion of the coolant flow path 400 that extends from the motor cooler 126 to the filler 450. One end of the coolant tube 430*d* is connected to the motor cooler 126 to communicate with the space inside the motor cooler 126. In addition, the other end of the coolant tube 430*d* is connected to one end of the coolant tube 430*e* to communicate with the coolant tube 430*e*. The lower end of the coolant tube 430*d* (the lowest portion in the coolant tube 430*d*) is connected to the motor cooler 126. The coolant tube 430*d* is an example of the second coolant tube.

The coolant tube 430*e* defines a portion of the coolant flow path 400 that extends from the filler 450 to the heat exchanger 440. One end of the coolant tube 430*e* is connected to the filler 450. The other end of the coolant tube 430*e* is connected to the heat exchanger 440 to communicate with the flow path of the coolant liquid C in the heat exchanger 440.

The coolant tube 430*f* defines a portion of the coolant flow path 400 that extends from the heat exchanger 440 to the pump 410. One end of the coolant tube 430*f* is connected to the heat exchanger 440 to communicate with the flow path of the coolant liquid C in the heat exchanger 440. The other end of the coolant tube 430*f* is connected to the pump 410 to communicate with the flow path of the coolant liquid C in the pump 410.

The coolant flow path 400 is configured such that the coolant liquid C pumped by the pump 410 flows in the order of the MCU 510, the air vent 420, the motor cooler 126, the filler 450, and the heat exchanger 440, and then circulates back to the pump 410.

Specifically, first, the coolant liquid C flows out of the pump 410, passes through the coolant tube 430*a*, and flows into the space 512. The coolant liquid C that flows into the space 512 flows near the MCU 510 to cool the MCU 510.

Next, the coolant liquid C flows out of the space 512, passes through the coolant tube 430*b*, and flows into the coolant tube 430*c* to flow near the air vent 420. If air has been mixed into the coolant liquid C at this time, the air flows towards the air vent 420, which is located higher than the connection between the coolant tubes 430*b*, 430*c* and is released to the atmosphere via the air vent 420 (arrow A in FIGS. 3 and 4).

Next, the coolant liquid C passes through the coolant tube 430*c* and flows into the space inside the motor cooler 126. The coolant liquid C that flows into the space inside the motor cooler 126 flows near the electric motor 122 to cool the electric motor 122.

Next, the coolant liquid C flows out of the space inside the motor cooler 126, passes through the coolant tube 430*d*, and flows into the coolant tube 430*e* to flow near the filler 450. If air has been mixed into the coolant liquid C at this time, the air flows towards the filler 450, which is located higher than the connection between the coolant tubes 430*d* and 430*e*, and is released to the atmosphere via the filler 450 (arrow A in FIGS. 3 and 4).

Next, the coolant liquid C passes through the coolant tube 430*e* and flows into the heat exchanger 440. In the heat exchanger 440, the coolant liquid C is cooled by exchanging heat with seawater pumped in from outside the outboard motor 100.

Next, the coolant liquid C flows out of the heat exchanger 440, passes through the coolant tube 430*f*, and flows into the pump 410. Thus, the coolant liquid C circulates through the coolant flow path 400.

Figure 5:
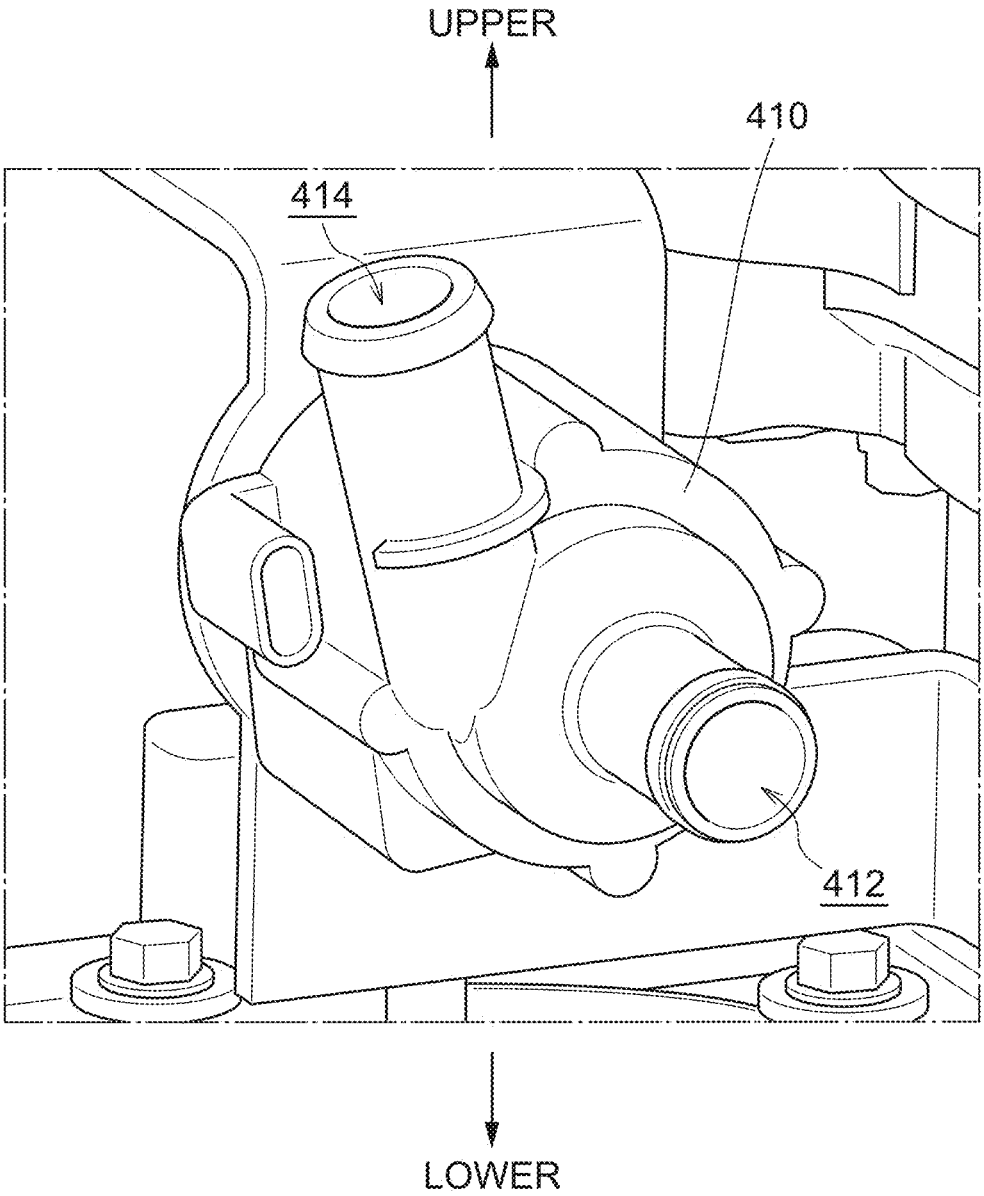
FIG. 5 is an explanatory view illustrating a detailed configuration of a pump.

FIG. 5 is an explanatory view illustrating a detailed configuration of the pump 410. The pump 410 includes a suction port 412 and a discharge port 414. The suction port 412 is connected to the coolant tube 430*f* and into which the coolant liquid C flows from the outside of the pump 410. The suction port 412 is near the center of the pump 410 in the upper-lower direction. The discharge port 414 is connected to the coolant tube 430*a* and from which the coolant liquid C flows out towards the outside of the pump 410. The discharge port 414 is located at a substantially uppermost portion of the pump 410.

As explained above, an example embodiment of the outboard motor 100 includes the drive source, the MCU 510, the plurality of coolant tubes 430*a* to 430*f*, the pump 410, and the air vent 420. The drive source includes the electric motor 122. The MCU 510 is located higher than the electric motor 122 and controls the electric motor 122. The coolant tubes 430*a* to 430*f* define at least a portion of the coolant flow path 400 through which the coolant liquid C circulates to cool the electric motor 122 and the MCU 510. The pump 410 is connected to the coolant tubes 430*a* and 430*f* to pump the coolant liquid C. The air vent 420 is located at an uppermost portion of the coolant flow path 400. The coolant flow path 400 is configured such that the coolant liquid C pumped by the pump 410 flows in the order of the MCU 510, the air vent 420, and the electric motor 122.

According to the outboard motor 100 of an example embodiment, e.g., when filling the coolant flow path 400 with the coolant liquid C, if air also enters the coolant flow path 400, the air pumped by the pump 410 along with the coolant liquid C will pass through the MCU 510 to reach the air vent 420 located at the uppermost portion of the coolant flow path 400. This makes it less likely for air to be trapped near the MCU 510, which is one of the devices of the outboard motor 100 and tends to become relatively hot, thus improving the cooling efficiency of the outboard motor 100. By improving the cooling efficiency of the outboard motor 100, the durability of each device of the outboard motor 100 is improved, and this in turn improves the durability of the outboard motor 100.

In addition, in the outboard motor 100 of an example embodiment, the pump 410 is located lower than the MCU 510. According to the outboard motor 100, e.g., when filling the coolant flow path 400 with the coolant liquid C, if air also enters the coolant flow path 400, the air pumped by the pump 410 along with the coolant liquid C will pass through the MCU 510, which is located higher than the pump 410 to reach the air vent 420, which is located at an uppermost portion of the coolant flow path 400. This makes it less likely for air to be trapped in the section from the pump 410 to the air vent 420, thus more effectively improving the cooling efficiency of the outboard motor 100.

In addition, the outboard motor 100 further includes the controller case 502 that houses the MCU 510, the coolant flow path 400 includes the space 512 inside the controller case 502, the plurality of coolant tubes 430*a* to 430*f* include the coolant tube 430*b* that is connected to the controller case 502 and defines a portion of the coolant flow path 400 that extends from the controller case 502 to the air vent 420, and the lower end of the coolant tube 430*b* is connected to the controller case 502. According to the outboard motor 100 of an example embodiment, e.g., when filling the coolant flow path 400 with the coolant liquid C, if air also enters the coolant flow path 400, the air pumped by the pump 410 along with the coolant liquid C will pass through the controller case 502, enter into the coolant tube 430*b*, and flow from the connection with the controller case 502, which is the lower end of the coolant tube 430*b*, towards the air vent 420. This makes it less likely for air to be trapped in the section from the pump 410 to the air vent 420, thus more effectively improving the cooling efficiency of the outboard motor 100.

In addition, the outboard motor 100 further includes the filler 450 that is a filling port for the coolant liquid C in the coolant flow path 400 and is located higher than the electric motor 122, the coolant flow path 400 is configured such that the coolant liquid C pumped by the pump 410 flows in the order of the MCU 510, the air vent 420, the electric motor 122, and the filler 450. According to the outboard motor 100 of an example embodiment, e.g., when filling the coolant flow path 400 with the coolant liquid C, if air also enters the coolant flow path 400, the air pumped by the pump 410 along with the coolant liquid C will pass through the electric motor 122 to reach the filler 450, which is located higher than the electric motor 122. This makes it less likely for air to be trapped near the electric motor 122, which is one of the devices of the outboard motor 100 and tends to become relatively hot, thus more effectively improving the cooling efficiency of the outboard motor 100.

In addition, the outboard motor 100 further includes the motor cooler 126 surrounding the outer circumference of the electric motor 122, the coolant flow path 400 includes a space inside the motor cooler 126, the plurality of coolant tubes 430*a* to 430*f* include the coolant tube 430*d* connected to the motor cooler 126 and defines a portion of the coolant flow path 400 that extends from the motor cooler 126 to the filler 450, and the lower end of the coolant tube 430*d* is connected to the motor cooler 126. According to the outboard motor 100 of an example embodiment, e.g., when filling the coolant flow path 400 with the coolant liquid C, if air also enters the coolant flow path 400, the air pumped by the pump 410 along with the coolant liquid C will pass through the motor cooler 126, enter into the coolant tube 430*d*, and flow from the connection with the motor cooler 126, which is the lower end of the coolant tube 430*d*, towards the filler 450. This makes it less likely for air to be trapped in the section from the motor cooler 126 to the filler 450, thus more effectively improving the cooling efficiency of the outboard motor 100.

In addition, in the outboard motor 100, the discharge port 414 of the pump 410 is located at a substantially uppermost portion of the pump 410. According to the outboard motor 100 of an example embodiment, since the discharge port 414 of the pump 410 is located at a substantially uppermost portion of the pump 410, it is less likely for air to be trapped inside the pump 410, thus more effectively improving the cooling efficiency of the outboard motor 100.

The technologies disclosed herein are not limited to the above-described example embodiments and may be modified in various ways without departing from the gist of the present invention, including the following modifications.

The configurations of the boats 10 and the outboard motors 100 of the example embodiments are only examples and may be variously modified. For example, the drive source of the above example embodiments only includes the electric motor 122, but the drive source may include both the electric motor and an engine such as an internal combustion engine.

In the above example embodiments, the MCU 510 is located higher than the electric motor 122, but this is not necessarily the case, and the MCU may be located lower than the electric motor.

In the above example embodiments, there are a plurality of coolant tubes 430*a* to 430*f*, but it is not necessary to provide the plurality of coolant tubes, and only one coolant tube may be provided.

In the above example embodiments, the pump 410 is located lower than the MCU 510, but this is not necessarily the case, and the pump may be located higher than the MCU.

In the above example embodiments, the space 512 is provided in the controller case 502, and the MCU 510 is cooled by the coolant liquid C flowing into the space 512, but the configuration is not necessarily limited to this. For example, the coolant tube may be arranged near the MCU, and the MCU may be cooled by the coolant liquid flowing through the coolant tube. Similarly, in the above example embodiments, a space is provided inside the motor cooler 126, and the electric motor 122 is cooled by the coolant liquid C flowing into the space inside the motor cooler 126, but the configuration is not necessarily limited to this. For example, the coolant tube may be located near the electric motor, and the electric motor may be cooled by the coolant fluid flowing through the coolant tube.

In the above example embodiments, the lower end of the coolant tube 430*b* is connected to the controller case 502, but the configuration is not necessarily limited to this. Similarly, in the above example embodiments, the lower end of the coolant tube 430*d* is connected to the motor cooler 126, but the configuration is not necessarily limited to this.

In the above example embodiments, the discharge port 414 of the pump 410 is located at a substantially uppermost portion, but the configuration is not necessarily limited to this.

In the above example embodiments, coolant liquid C (antifreeze mainly including ethylene glycol or propylene glycol) is shown as an example coolant, but the type of coolant is not limited as long as it cools the electric motor and motor controller.

In the above example embodiments, the motor controller is exemplified by the MCU 510, but it may be another motor controller such as an inverter.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a drive source including an electric motor;

a motor controller located higher than the electric motor and configured or programmed to control the electric motor;

a coolant tube that defines at least a portion of a coolant flow path through which coolant that cools the electric motor and the motor controller circulates;

a pump connected to the coolant tube to pump the coolant; and an air vent located at an uppermost portion of the coolant flow path; wherein the coolant flow path is configured to cause the coolant pumped by the pump to flow in an order of the motor controller, the air vent, and the electric motor.

2. The outboard motor according to claim 1, wherein the pump is located lower than the motor controller.

3. The outboard motor according to claim 1, further comprising:

a controller case that houses the motor controller; wherein the coolant flow path includes a space inside the controller case;

the coolant tube includes a first coolant tube connected to the controller case and defines a portion of the coolant flow path that extends from the controller case to the air vent; and a lower end of the first coolant tube is connected to the controller case.

4. The outboard motor according to claim 2, further comprising:

a controller case that houses the motor controller; wherein the coolant flow path includes a space inside the controller case;

the coolant tube includes a first coolant tube connected to the controller case and defines a portion of the coolant flow path that extends from the controller case to the air vent; and a lower end of the first coolant tube is connected to the controller case.

5. The outboard motor according to claim 1, further comprising:

a filler for the coolant in the coolant flow path and located higher than the electric motor; wherein the coolant flow path is configured to cause the coolant pumped by the pump to flow in an order of the motor controller, the air vent, the electric motor, and the filler.

6. The outboard motor according to claim 2, further comprising:

a filler for the coolant in the coolant flow path and located higher than the electric motor; wherein the coolant flow path is configured to cause the coolant pumped by the pump to flow in an order of the motor controller, the air vent, the electric motor, and the filler.

7. The outboard motor according to claim 3, further comprising:

a filler for the coolant in the coolant flow path and located higher than the electric motor; wherein the coolant flow path is configured to cause the coolant pumped by the pump to flow in an order of the motor controller, the air vent, the electric motor, and the filler.

8. The outboard motor according to claim 5, further comprising:

a motor cooler to surround an outer circumference of the electric motor; wherein the coolant flow path includes a space inside the motor cooler;

the coolant tube includes a second coolant tube connected to the motor cooler and defines a portion of the coolant flow path that extends from the motor cooler to the filler; and a lower end of the second coolant tube is connected to the motor cooler.

9. The outboard motor according to claim 6, further comprising:

a motor cooler to surround an outer circumference of the electric motor; wherein the coolant flow path includes a space inside the motor cooler;

the coolant tube includes a second coolant tube connected to the motor cooler and defines a portion of the coolant flow path that extends from the motor cooler to the filler; and a lower end of the second coolant tube is connected to the motor cooler.

10. The outboard motor according to claim 7, further comprising:

a motor cooler to surround an outer circumference of the electric motor; wherein the coolant flow path includes a space inside the motor cooler;

the coolant tube includes a second coolant tube connected to the motor cooler and defines a portion of the coolant flow path that extends from the motor cooler to the filler; and a lower end of the second coolant tube is connected to the motor cooler.

11. The outboard motor according to claim 1, wherein the pump includes an outlet at an uppermost portion or a substantially uppermost portion of the pump.

12. The outboard motor according to claim 2, wherein the pump includes an outlet at an uppermost portion or a substantially uppermost portion of the pump.

13. The outboard motor according to claim 3, wherein the pump includes an outlet at an uppermost portion or a substantially uppermost portion of the pump.

14. A boat comprising:

a hull; and the outboard motor according to claim 1 mounted to a rear portion of the hull.

15. A boat comprising:

a hull; and the outboard motor according to claim 2 mounted to a rear portion of the hull.

16. A boat comprising:

a hull; and the outboard motor according to claim 3 mounted to a rear portion of the hull.

17. An outboard motor comprising:

a drive source including an electric motor;

a motor controller configured or programmed to control the electric motor;

a coolant tube that defines at least a portion of a coolant flow path through which a coolant that cools the electric motor and the motor controller circulates;

a pump connected to the coolant tube to pump the coolant; and an air vent located at an uppermost portion of the coolant flow path; wherein the coolant flow path is configured to cause the coolant pumped by the pump to flow in an order of the motor controller, the air vent, and the electric motor.

* * * * *